US005651207A

United States Patent [19]

Knight

[11] Patent Number: 5,651,207

[45] Date of Patent: Jul. 29, 1997

[54] RIFLE RAMROD WITH CLEANING JAG

[75] Inventor: William A. Knight, Centerville, Iowa

[73] Assignee: Modern Muzzleloading, Inc., Centerville, Iowa

[21] Appl. No.: 494,109

[22] Filed: Jun. 23, 1995

[51] Int. Cl.[6] ..... F41A 29/00

[52] U.S. Cl. ..... 42/95; 42/51; 89/31; 15/104.165

[58] Field of Search ..... 42/51, 90, 95; 89/31; 15/104.16, 104.165

[56] References Cited

U.S. PATENT DOCUMENTS

| | | | |
|---|---|---|---|
| 553,472 | 1/1896 | Keller | 42/95 |
| 863,762 | 8/1907 | Sheakley | 15/104.165 |
| 1,008,548 | 11/1911 | King | 42/95 |
| 1,192,174 | 7/1916 | Dvorak | 15/104.165 |
| 2,966,688 | 1/1961 | Daubert | 15/104.16 |
| 4,858,360 | 8/1989 | Hardin | 42/95 |
| 4,866,871 | 9/1989 | Rivers | 42/95 |
| 4,890,406 | 1/1990 | French | 42/90 |
| 5,127,179 | 7/1992 | Marsh | 42/95 |

*Primary Examiner*—Michael J. Carone
*Assistant Examiner*—Theresa M. Wesson
*Attorney, Agent, or Firm*—Zarley, McKee, Thomte, Voorhees, & Sease

[57] ABSTRACT

A cleaning jag assembly for use with the ramrod of a rifle comprises an elongated rod having threads at its inner and outer ends with the threads at the inner end being adapted for threadable engagement with an internally threaded bushing on the outer end of a ramrod. The outer end of the rod is threadably engaged with a cleaning jag. The rod has an unthreaded central portion except for a segment of threads that exist at the rearward end of the cleaning jag. Those threads are adaptable for engagement with the threads in the bushing when the rod is unthreaded from the bushing at its inner end, slidably moved through the bushing, and then threadably engaged by joining the threads of the segment with the threads at the outer end of the bushing.

8 Claims, 2 Drawing Sheets

22
48
40
56
26
28
30
54
50
52
60
58
44
46
34
36
38
32
45

RIFLE RAMROD WITH CLEANING JAG

BACKGROUND OF THE INVENTION

Ramrods are an essential part of muzzleloading rifle usage. The ramrods are normally detachably carried under the rifle barrel, and are used upon each loading of the firearm.

It is also desirable to clean the rifle barrel after every shot, or at least frequently. This is done by inserting a cleaning jag down the barrel by means of an elongated rod. The conventional cleaning jag may be used in conjunction with a cleaning patch. Carrying the cleaning rod and jag, or affixing the cleaning jag to the ramrod is a serious inconvenience in the fields, particularly in a hunting situation.

It is therefore a principal object of this invention to provide a rifle ramrod with a cleaning jag so that the ramrod can be used for its conventional purpose and also for quickly and easily cleaning the rifle bore.

SUMMARY OF THE INVENTION

An elongated tubular rifle ramrod has an internally-threaded bushing. An elongated rod, shorter than the ramrod, is slidably mounted in the bore of the bushing. An inner end of the rod is threaded to permit the rod to be threadably held by the bushing when the rod is extended forwardly out of the bushing. The outer end of the rod is also threaded with a portion of the threads engaging the inner threads of a central bore in a cleaning jag. For storage, the rod is unscrewed from the bushing, pushed inwardly into the ramrod through the bushing, and the threads extending rearwardly beyond the cleaning jag are then threadably secured within the bushing so that the cleaning jag is positioned just beyond the forward end of the ramrod.

DESCRIPTION OF THE PREFERRED EMBODIMENT

Figure 1:
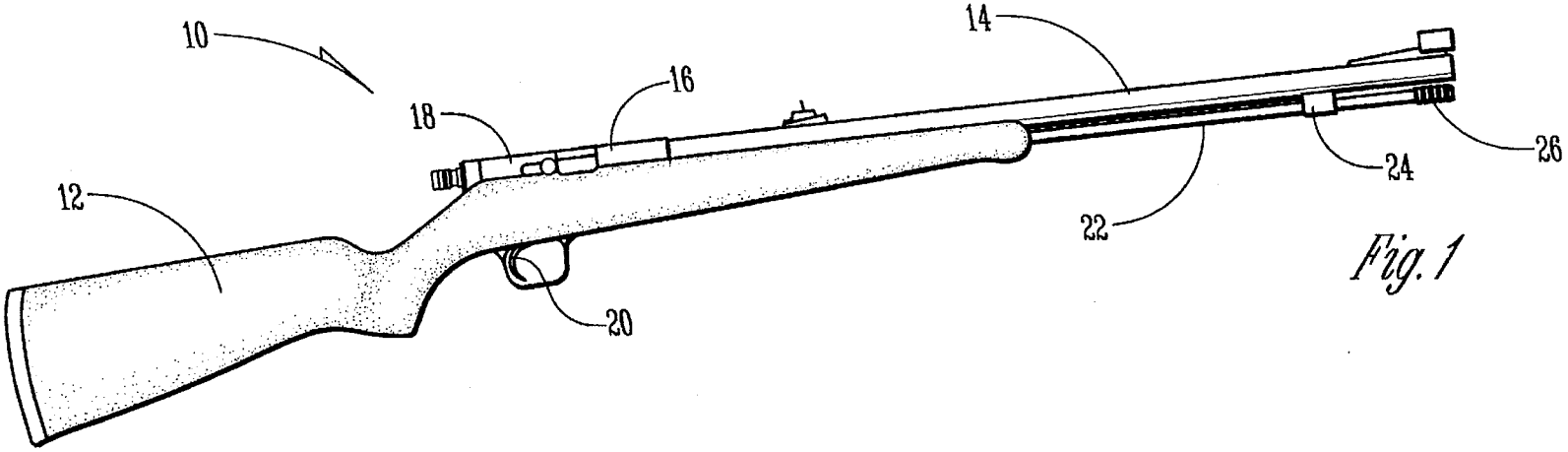
FIG. 1 is a side elevational view of a conventional muzzleloading rifle showing the invention herein.

A muzzleloading rifle 10 in FIG. 1 has a conventional stock 12, a barrel 14, a receiver 16, a bolt 18, and a trigger assembly 20. A conventional ramrod 22 for loading the rifle is retained on the under side of the barrel by conventional bracket 24.

Figures 3, 4, 5:
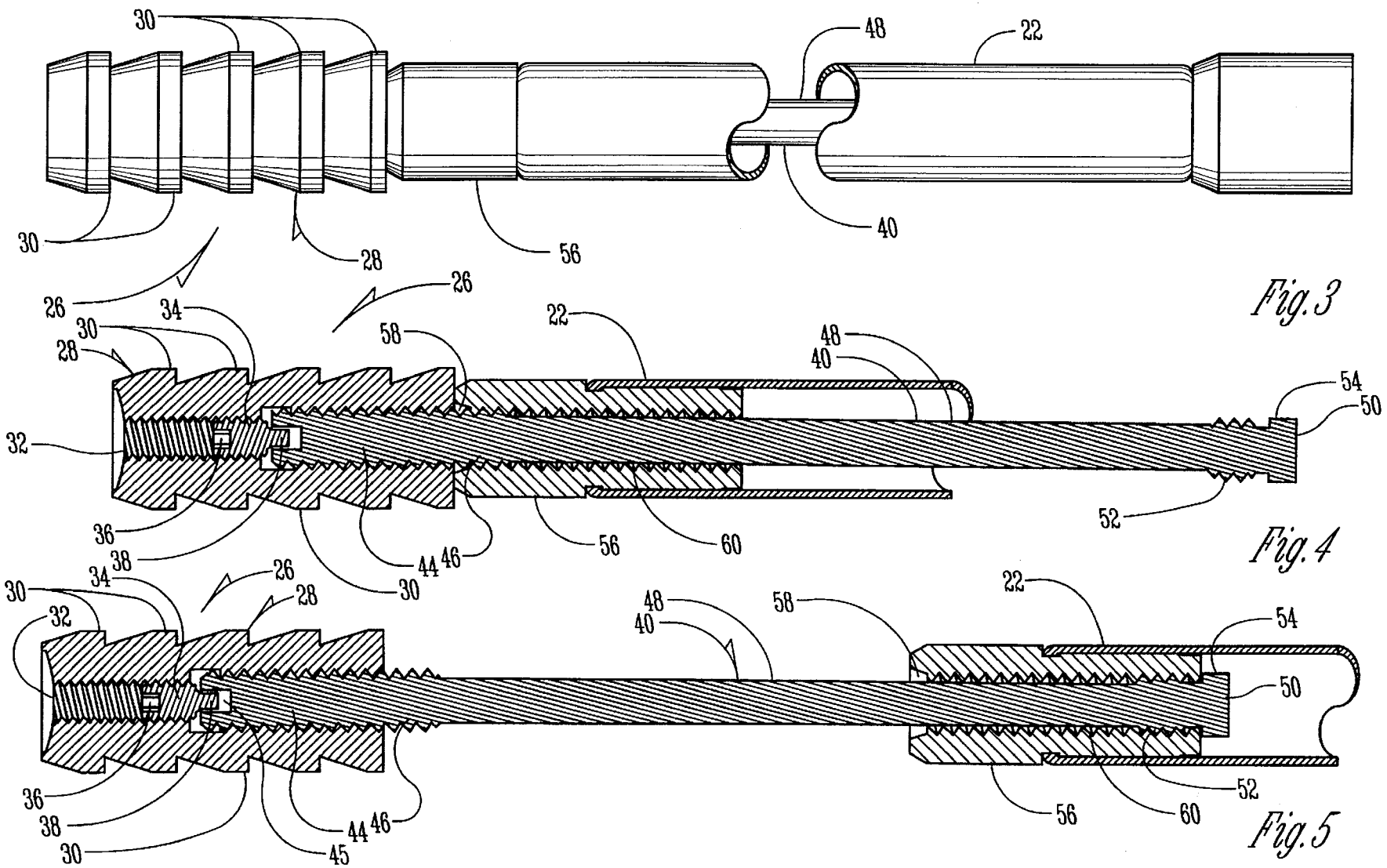
FIG. 3 is a partial sectional view of the ramrod with the cleaning jag assembly mounted in the ramrod for storage.
FIG. 4 is a partial sectional view taken on the longitudinal axis of the forward end of the ramrod with the cleaning jag in a storage position.
FIG. 5 is a view similar to that of FIG. 4 but with the cleaning jag assembly in an extended operational position.

With reference to FIGS. 3 and 4, a cleaning jag assembly 26 has a conventional cleaning jag 28 with serrated elements 30. Jag 28 has a threaded center bore 32 in which is mounted a conventional allen screw 34 or the like having a notch 36 and a protruding lug 38.

Figure 2:
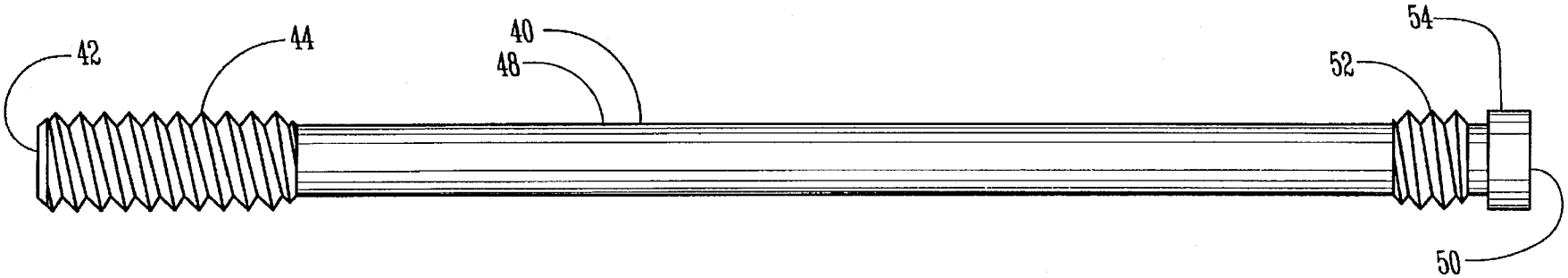
FIG. 2 is an enlarged scale side elevational view of the cleaning jag assembly of this invention.

A rod 40 (FIGS. 2, 3 and 4) has a outer end 42 with threads 44 that are threadably received in the threaded bore 32 of jag 28. The length of threads 44 causes the rearward threaded portion 46 thereof to extend rearwardly from the jag 28 as best seen in FIG. 4. A notch 45 appears in the outer end 42 of rod 40 and receives the lug 38 on screw 34. Rod 40 also comprises an unthreaded central portion 48 which extends from the rearward threads 46 on the forward end of the rod to the inner end 50 of the rod. A short segment of threads 52 appears at the rearward end of the rod (FIGS. 2 and 4), and the inner end of the rod 40 terminates in a retaining flange 54 of increased diameter. It should be noted that the unthreaded central portion 48 of rod 40 has a diameter less than the threads 44, 46 and 52 at opposite ends of the rod.

As best shown in FIG. 5, rod 40 extends through bushing 56 mounted in the outer end of the conventional ramrod 22. Bushing 56 has an axial bore 58 with internal threads cut substantially along its interior length.

In normal storage usage, as best shown in FIG. 4, the cleaning jag assembly 26 is rigidly secured to the end of ramrod 22 by screwing the assembly into the outer end of bushing 56. This is accomplished by the engagement of the rearward threads 46 (FIG. 5) being screwed into the outer threaded end of bore 58 of bushing 56 to engage the threads 60.

When it is desired to use the cleaning jag assembly 26 for cleaning purposes, the threaded connection between threads 46 and 60 is released by unscrewing the cleaning jag assembly from bushing 56. The cleaning jag assembly is then moved from the position in FIG. 4 to the position of FIG. 5 by first sliding the rod 40 through the bushing and then threading the inner end of the rod to the threaded inner end of the bushing by means of screwing the threads 52 into engagement with the threads 60. This action maintains the rod 40 in rigid extended engagement with the outer end of the ramrod 22 as best shown in FIG. 5. The cleaning jag 28 is then free to be used to clear debris from the barrel of the weapon. The cleaning jag assembly can then be moved from the operational position of FIG. 5 back to the storage position of FIG. 4 by reversing the procedures outlined above.

It is therefore seen that this invention will eliminate a necessity for the hunter or marksman to carry a cleaning rod in addition to the ramrod that is typically affixed to the weapon. It is therefore seen that this invention will achieve at least all of its stated objectives.

What is claimed is:

1. A cleaning jag assembly moveably mountable within the ramrod of a rifle, comprising, an elongated rod having male threaded inner and outer ends and an unthreaded central portion, said central portion having a diameter less than the respective major diameters of said threaded inner and outer ends, a cleaning jag having a female thread therein whereby said cleaning jag is threadedly attached to said male threaded outer end of said rod; and the threaded outer end being adapted to retain the assembly in a storage position relative to the ramrod and the threaded inner end being adapted to retain the assembly in a use position relative to the ramrod.

2. The device of claim 1 wherein a portion of the threads on said outer end of said rod extend inwardly from said cleaning jag.

3. The device of claim 1 wherein a retaining flange is located on the inner end of said rod.

4. The device of claim 1 wherein the threads on the inner end have a thread size which is identical to the threads on the outer end.

5. A ramrod for rifles, comprising, an elongated hollow rod having an outer end, a bushing on said outer end having a longitudinally extending threaded bore, an elongated rod having threaded inner and outer ends and an unthreaded central portion extending through said bore, and a cleaning jag threaded on the outer end of said elongated rod.

6. The device of claim 5 wherein a portion of the threads on said outer end of said elongated rod extend inwardly from said cleaning jag.

7. The device of claim 5 wherein a retaining flange is located on the inner end of said elongated rod.

8. The device of claim 5 wherein said central portion has a diameter less than the diameter of said threaded inner end.

* * * * *